US005914007A

United States Patent [19]

Henssler et al.

[11] Patent Number: 5,914,007

[45] Date of Patent: Jun. 22, 1999

[54] PRESS DEVICE WITH CLOSEABLE GROOVES FOR SMOOTH PRESS FACE

[75] Inventors: Joachim Henssler, Ravensburg; Hans Loser, Langenau; Karl Steiner, Herbrechtingen, all of Germany

[73] Assignee: Voith Sulzer Papiermaschinen GmbH, Heidenheim, Germany

[21] Appl. No.: 08/878,552

[22] Filed: Jun. 19, 1997

[30] Foreign Application Priority Data

Jul. 1, 1996 [DE] Germany ..... 196 26 420

[51] Int. Cl.[6] ..... D21F 3/02

[52] U.S. Cl. ..... 162/205; 100/153; 100/155 R; 162/358.1; 162/358.3

[58] Field of Search ..... 162/358.1, 358.3, 162/205; 100/153, 155 R

[56] References Cited

U.S. PATENT DOCUMENTS

| | | | |
|---|---|---|---|
| 1,925,917 | 6/1933 | Chalon | 162/900 |
| 3,198,694 | 8/1965 | Justus | 162/361 |
| 4,559,106 | 12/1985 | Skyttä et al. | 162/358.1 |
| 4,880,501 | 11/1989 | Schiel | 162/358.4 |
| 5,543,015 | 8/1996 | Termo | 162/901 |
| 5,700,356 | 12/1997 | Lefkowitz | 162/358.2 |

FOREIGN PATENT DOCUMENTS

| | | |
|---|---|---|
| 241389 | 10/1987 | European Pat. Off. . |
| 6918845 | 6/1970 | Germany . |
| 2814682 | 10/1979 | Germany . |
| 2951299 | 7/1981 | Germany . |
| 3416423 | 11/1984 | Germany . |
| 2208879 | 4/1989 | United Kingdom . |

OTHER PUBLICATIONS

Behrendt et al., "Beschichtete Walzen erfullen viefaltige Funktionen in Fertigung sprozessen", *Maschinenmarkt, Wurzburg,* 88, pp. 1648–1650 (1982).

*Primary Examiner*—Karen M. Hastings
*Attorney, Agent, or Firm*—Greenblum & Bernstein, P.L.C.

[57] ABSTRACT

Press device for treating a material web that may includes an impermeable press element having a press face, an opposing element, and a nip formed between the press element and the opposing element. The press device may also include a felt belt that guides the material web through the nip and that is positioned between the material web and the opposing element. The material web may be separated from the press element after leaving the nip because the press element may further include at least one of grooves and holes formed in the press face that close in the nip due to pressing forces to form a smooth surface, and that open after leaving the nip.

32 Claims, 5 Drawing Sheets

PRESS DEVICE WITH CLOSEABLE GROOVES FOR SMOOTH PRESS FACE

CROSS-REFERENCE TO RELATED APPLICATION

The present application claims the priority under 35 U.S.C. § 119 of German Patent Application No. 196 26 420.0, filed Jul. 1, 1996, the disclosure of which is expressly incorporated by reference herein in its entirety.

BACKGROUND OF THE INVENTION

1. Field of the Invention

The present invention relates to a press device for treating a material web, e.g., a paper web. The press device may include a press element with a substantially smooth press face and an opposing element that cooperates with the press element to form a nip. The material web may be guided through the nip with a felt belt positioned between the material web and the opposing element, and the material web may be separated from the press element after leaving the nip.

2. Description of Background Information

Press devices similar in general to the press device discussed above are known in the prior art and utilized, e.g., for dewatering paper webs in paper machines. The web to be dewatered, together with a felt belt arranged between the opposing element and the web, is guided through the nip and dewatered. The felt belt absorbs the fluid pressed from the web.

However, the paper web adheres to the press element due to adhesion forces acting between the material web and the smooth press face of the press element Thus, after leaving the nip, the paper web must be separated from the press element to which it is adhered. The removal of the paper web from the press element is problematic, particularly at high web speeds, because the material web can be overstretched and torn if the removal does not occur gently enough.

SUMMARY OF THE INVENTION

An object of the present invention may be to develop a press device of the type generally described above so that, even at high web speeds, the material web may be gently released from the press element. In this manner, a danger of overstretching or tearing the material web may be minimized.

The above object may be achieved, i.e., to encourage a separation of the material web from the press element, by forming at least one of grooves and holes in a press face that close, in the nip, e.g., due to pressing forces, to form a smooth surface, and open again after leaving the nip.

The removal of the web from the press element may be facilitated by locating holes or grooves in the press face of the press element that close in the nip and open again when leaving it.

If the holes or grooves are relatively small, the removal of the web may be facilitated by this arrangement in that, when the holes or grooves close, the air contained within the holes or grooves may be compressed when the pressure to form the nip, i.e., exerted by the opposing element, is present The compressed air may then be released as soon as the holes or grooves reopen, i.e., after leaving the nip. This release of the air compressed within the holes or grooves may lead to a reduction in adhesion forces acting between the material web and the press face. Thus, the material web may be easily separated from the press element.

According to a particular embodiment of the present invention, the grooves may extend in a web travel direction for such a distance that, when passing through the nip, the air contained within the grooves may be substantially pressed out of the grooves, i.e., counter to the web travel direction and during the opening, i.e., when leaving the nip, air may flow back into the grooves. In this embodiment, air flowing back into the grooves may reduce the adhesion of the material web to the press element.

In another advantageous embodiment, a plurality of rows may include holes or grooves that may be positioned next to one another and evenly spaced apart lateral to the web travel direction. The plurality of rows may extend in a suitable manner substantially over an entire width of the material web. The holes or grooves may be offset lateral to the web travel direction from rows that are adjacent to one another in the web travel direction.

So that the holes or grooves may open and close in a desired manner, the press face, i.e. the press jacket, of the press element should include a sufficiently flexible material, e.g., polyurethane.

The present invention may be directed to a press device for treating a material web. The press device may include a press element having a press face, an opposing element, and a nip formed between the press element and the opposing element. The press device may also include a felt belt that guides the material web through the nip and that is positioned between the material web and the opposing element. The material web may be separated from the press element after leaving the nip because the press element may further include at least one of grooves and holes formed in the press face that close in the nip due to pressing forces to form a smooth surface, and that open after leaving the nip.

According to another feature of the present invention, the at least one of grooves and holes may include at least one groove extending in a web travel direction for a predetermined distance. When passing through the nip, the at least one groove presses air within the at least one of groove out in a direction substantially counter to the web travel direction, and when leaving the nip, the at least one groove receives air into the at least one groove.

According to another feature of the present invention, the press device may further include a plurality of rows, that includes the at least one of holes and grooves, in the press face and arranged next to one another and evenly spaced lateral to a web travel direction. Further, the at least one of holes and grooves of neighboring rows may be offset relative to one another lateral to the web travel direction.

According to a further feature of the present invention, the at least one of holes and grooves may be located substantially over an entire width of the press element.

According to yet another feature of the present invention, the at least one of holes and grooves may include at least one groove having a width of between approximately 0.1 mm and 0.3 mm and a depth of between approximately 2 mm and 5 mm.

According to still another feature of the present invention, the press element may be formed as a roll having an outer surface in which the at least one of holes and grooves are formed. Further, the press jacket may include polyurethane. Still further, the roll may include a deflection adjustment roll having a rotating press jacket.

According to another feature of the present invention, the material web may include a paper web.

According still another feature of the present invention, the press element may include a substantially smooth press face.

The present invention may also be directed to a press device for treating a material web. The press device may include a press element having an outer surface including at least one of a groove and hole, and including a flexible surface that biases the at least one of the groove and hole in a substantially open position. The press device may also include an opposing roll abuttingly positioned adjacent the press element such that the opposing roll may close the at least one of the groove and hole to form a nip having a substantially smooth press face.

According to another feature of the present invention, the opposing roll may force air out of the at least one of the groove and hole in the nip. Alternatively, the opposing roll may trap air within the at least one of the groove and hole in the nip.

According to still another feature of the present invention, the at least one of the groove and hole may include at least one of grooves and holes arranged over a width of the outer surface for receiving the material web. Further, the at least one of grooves and holes may be evenly spaced over the width of the outer surface, or, alternatively, the at least one of grooves and holes may be arranged in adjacent rows spaced over the width of the outer surface. Still further, the adjacent rows may be offset over the width of the outer surface.

According to yet another feature of the present invention, the outer surface may include polyurethane.

According to a further feature of the present invention, the at least one of the groove and hole may have a depth of between approximately 2 mm and 5 mm.

According to a still further feature of the present invention, the at least one of the groove and hole may have a width of between approximately 0.1 mm and 0.3 mm.

According to still another feature of the present invention, the press element may include a press roll and the outer surface may include a roll jacket. The at least one of the groove and hole may include a plurality of grooves having a length formed in a substantially circumferential direction of the roll jacket.

The present invention may be directed to a method for separating a material web from a press element in a press device after the material web has been treated by a nip formed between the press element and an opposing element The press element may include at least one of grooves and holes and the material web guided through the nip by a felt belt. The method may include closing the at least one of grooves and holes adjacent the material web as the material web enters the nip and opening the at least one of grooves and holes adjacent the material web as the material web exits the nip. The opening of the at least one of grooves and holes may facilitate the separation of the web material from the press element.

According to another feature of the present invention, the closing of the at least one of grooves and holes may include forcing air out of the at least one of grooves and holes in a direction opposite a material web transport direction. Further, the opening of the at least one of grooves and holes may include drawing air into the at least one of grooves and holes.

According to still another feature of the present invention, the closing of the at least one of grooves and holes may include trapping air within the at least one of grooves and holes. Further, the opening of the at least one of grooves and holes may include releasing the trapped air from within the at least one of grooves and holes.

Other exemplary embodiments and advantages of the present invention may be ascertained by reviewing the present disclosure and the accompanying drawing figures.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

Figure 1:
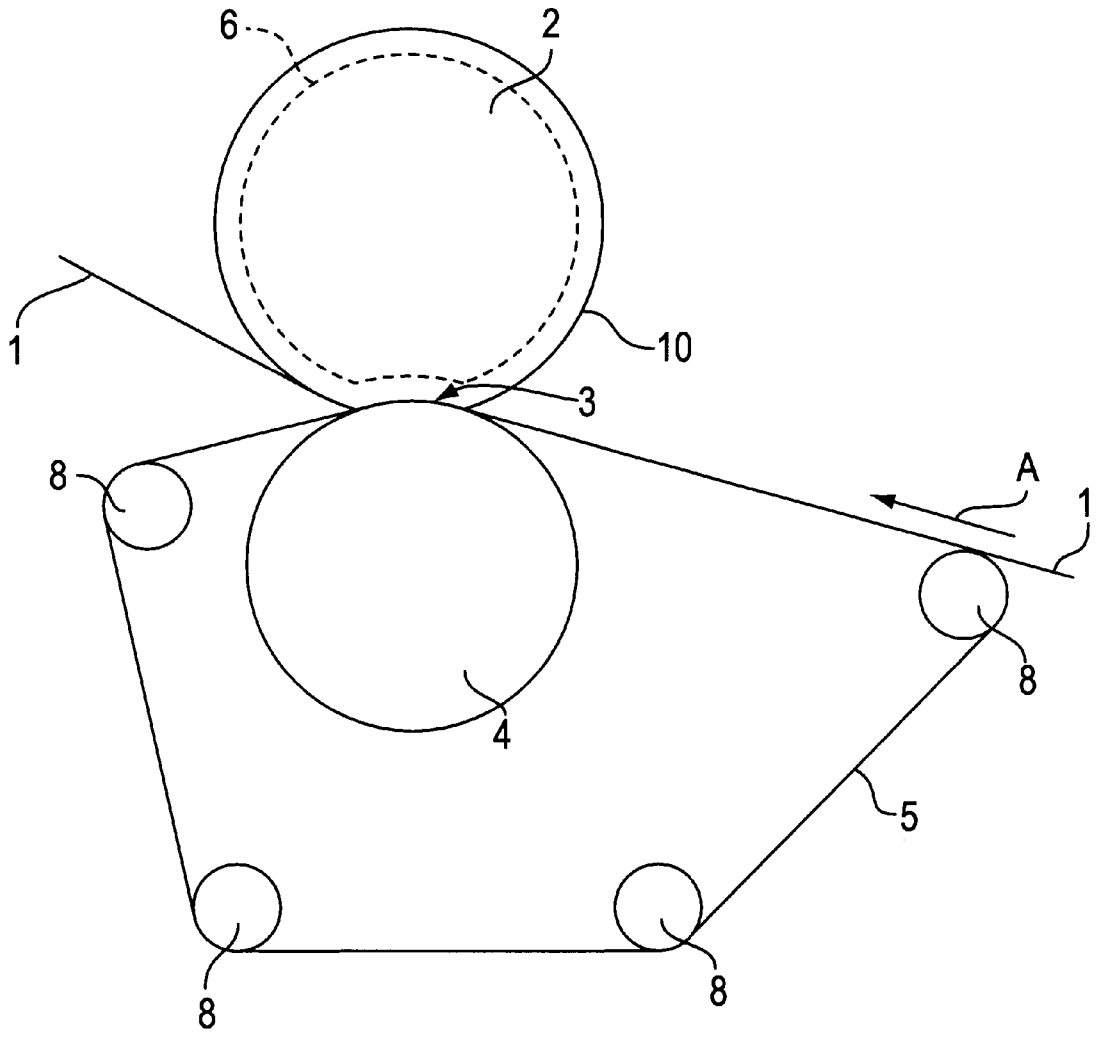
FIG. 1 illustrates a schematic side view of a basic design of a press device according to the present invention.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figures making apparent to those skilled in the art how the invention may be embodied in practice.

Figure 2:
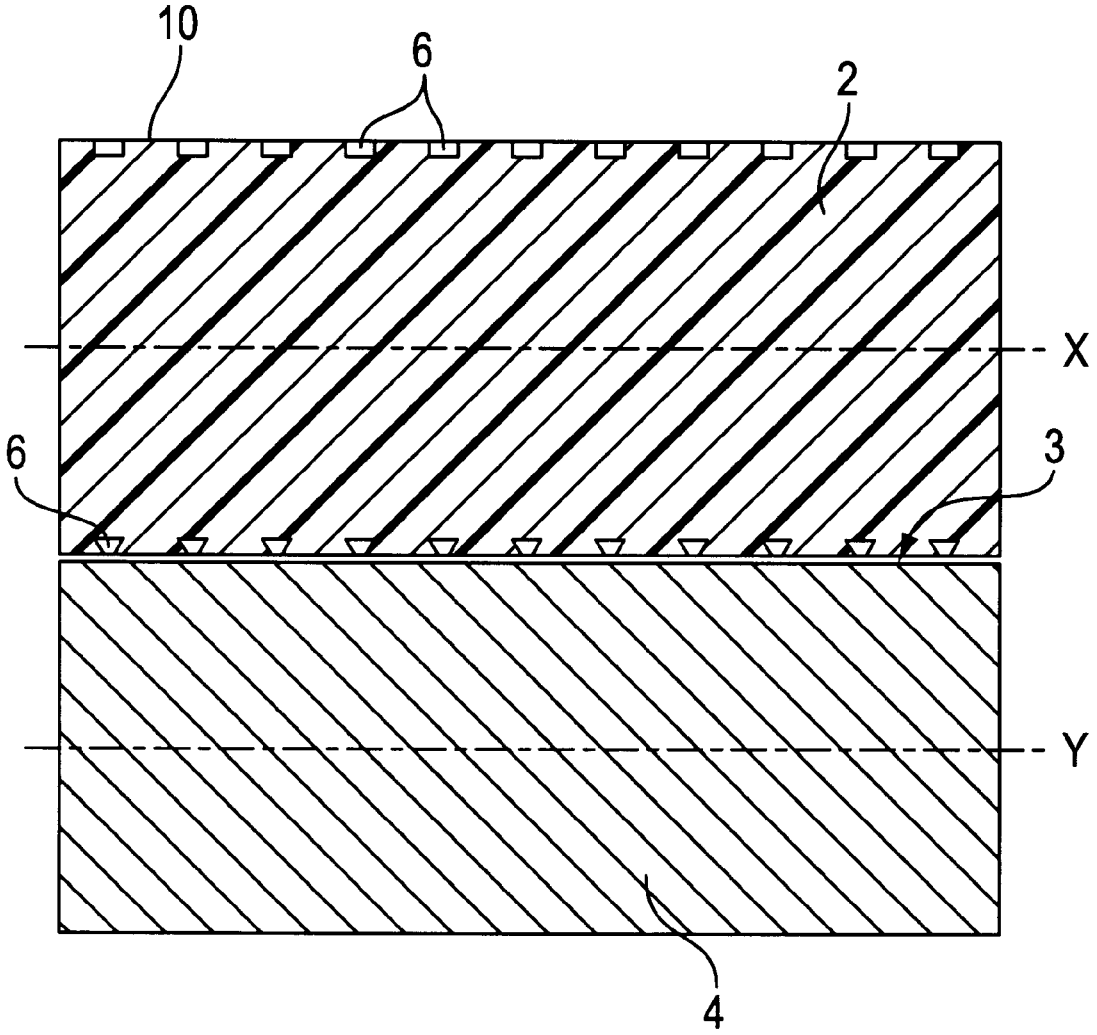
FIG. 2 illustrates a longitudinal section through the press device shown in FIG. 1.

FIGS. 1 and 2 illustrate a press device in accordance with the present invention, e.g., for dewatering a material web 1, e.g., a paper web. The press device may include an impermeable press element 2 having an axis X and having a substantially smooth press face 10 and an opposing element 4 having an axis Y. Impermeable press element 2 and opposing element 4 may be arranged to form a nip 3 and material web 1 and a felt belt 5 may be guided through nip 3. Felt belt 5 may be arranged as a bottom felt such that felt belt 5 may be positioned between material web 1 and opposing element 4.

Figure 3:
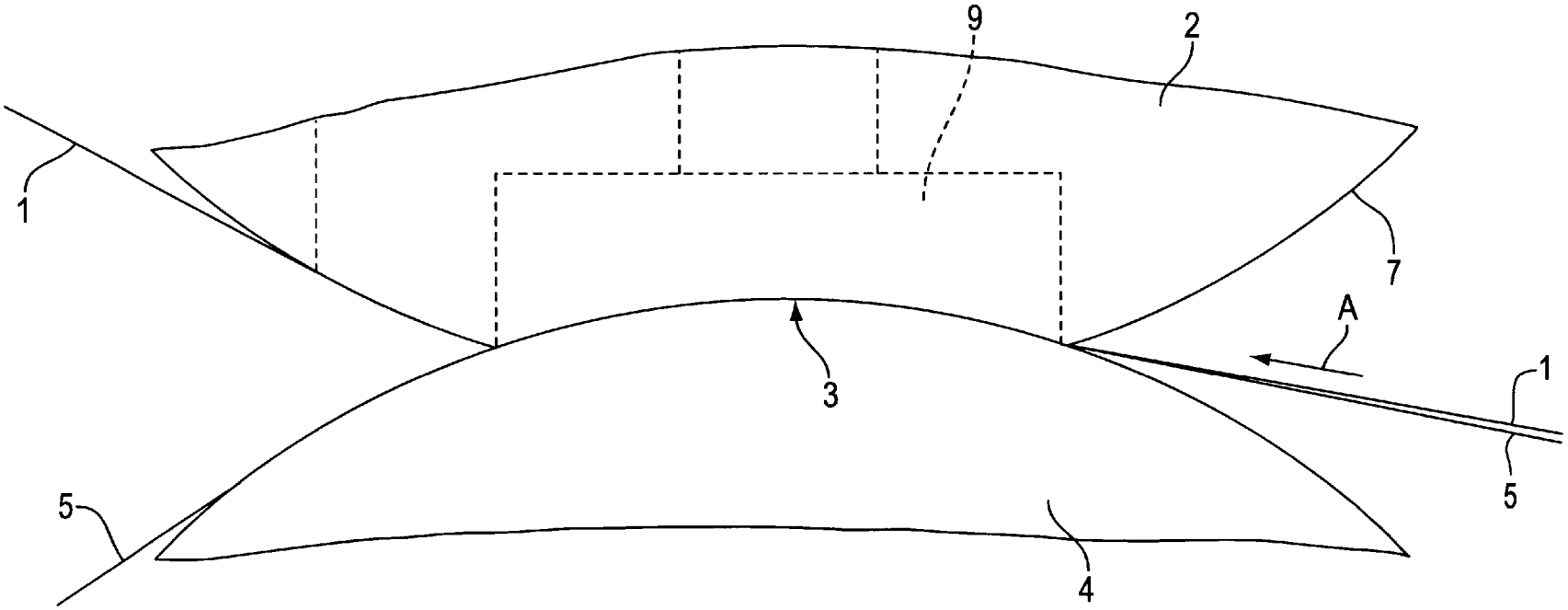
FIG. 3 illustrates an enlarged side view of an embodiment of a nip region of the press device depicted in FIGS. 1 and 2.

Opposing element 4 may include a rotating cylindrical roll, which may be formed as, e.g., a conventional or deflection controlled roll. As illustrated in FIGS. 1 and 3, impermeable press element 2 may have a concave press face 10 that complements the outer circumference of opposing element 4. A press jacket 7 may include of a flexible material that moves around a carrier (not shown) and may be supported on the carrier via at least one support element 9.

Figure 4:
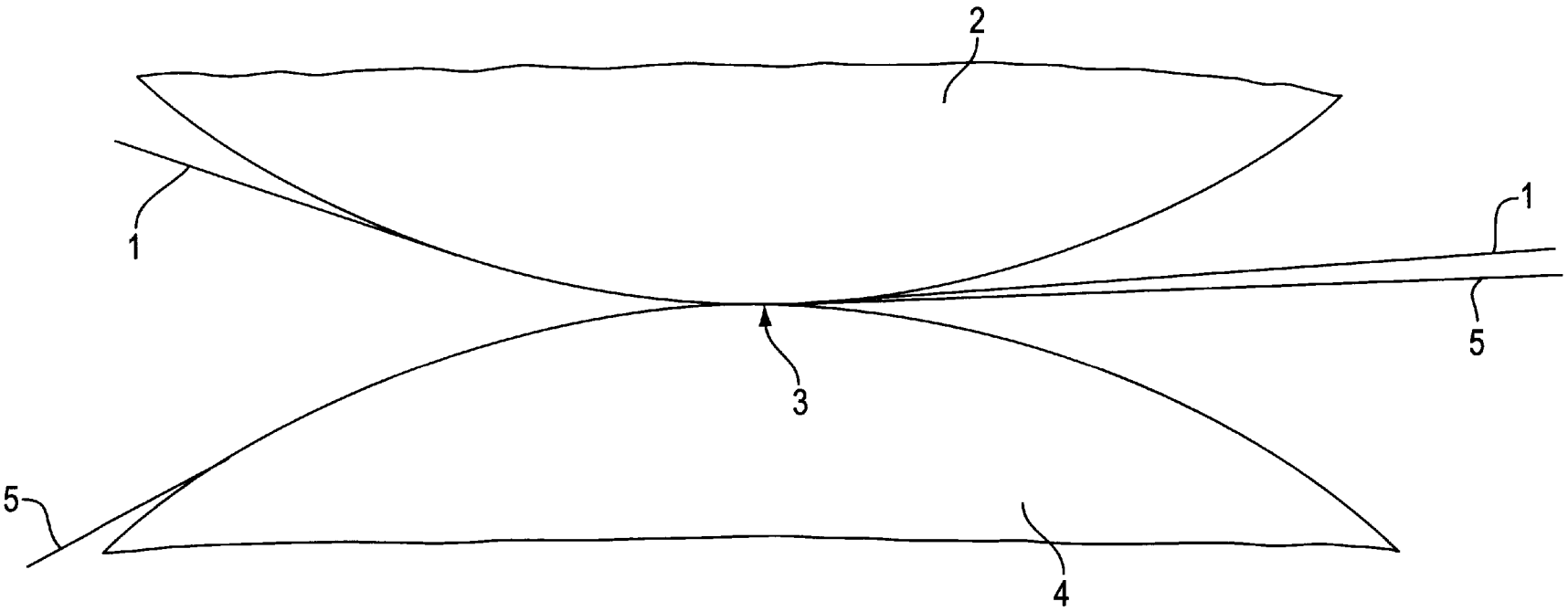
FIG. 4 illustrates an enlarged side view of an alternative embodiment of the nip region of the press device depicted in FIGS. 1 and 2.

In an alternative manner illustrated in FIG. 4, impermeable press element 2 and opposing element 4 may be include rotating cylindrical rolls. Thus, a smaller nip length may be formed in this alternative embodiment. Further, other devices and arrangements are contemplated in accordance with the present invention. For example, impermeable press element 2 and counter element 4 may include flexible roll jackets and broad press faces for treating the material web guided therebetween.

Felt belt 5 may be formed as an endless loop guided by a plurality of felt guide rolls 8. Felt guide rolls 8 may be utilized for, among other things, to guide the material web 1 ahead of and through nip 3.

Material web 1 may pass through nip 3 in a direction indicated by arrow A and may be dewatered in a conventional manner, i.e., the fluid pressed out of web 1 may be absorbed by felt belt 5.

To prevent a re-wetting of material web 1 after leaving nip 3, material web 1 may be quickly separated from felt belt 5 after exiting or leaving nip 3. As shown in FIG. 1, material web 1 may be guided along press element 2. Further, material web 1, upon exiting nip 3, may be adhered to impermeable press element 2, e.g., via adhesion forces that may be acting between material web I and smooth press face 10 of impermeable press element 2.

To facilitate separation of material web 1 from impermeable press element 2, at least one of blind holes and/or grooves 6 may be formed in press face 10 of press jacket 7. The material of press jacket 7 may be made of a flexible material, e.g., polyurethane, and the blind holes and/or grooves 6 may be sized such that, due to pressing forces exerted in forming nip 3, the blind holes and/or grooves 6 may close. Thus, within the formed nip 3, the surface of press face 10 may be a smooth surface. From the above and from FIG. 2, it is apparent that the smooth surface covers an entire length of the nip. Further, it is apparent that at least a portion of the grooves or blind holes 6 formed in the press face completely closes in the nip such that opposite sides of the grooves or blind holes 6 touch each other. Upon exiting or leaving nip 3, the blind hole and/or grooves 6 may again open, as shown in FIG. 2.

The blind holes or grooves 6 can have relatively small dimensions in the web travel direction A so that the air contained in them may be enclosed and compressed during the closing process. The compressed air may then be released again as soon as the blind holes or grooves 6 reopen after leaving the nip 3. This release may lead to a reduction of adhesion forces acting between material web 1 and press face 10, thus, enabling material web 1 be easily separated from impermeable press element 2.

Alternatively, blind holes and/or grooves 6 may extend, e.g., in web travel direction A for such a distance that, when passing through or forming nip 3, air contained within the holes and/or grooves may be substantially pressed out counter to web travel direction A and, when exiting nip 3, air may flow back into blind holes and/or grooves 6 and reopen them. In this alternative embodiment, the air flowing back into blind holes and/or grooves 6 may reduce the adhesion of material web 1 to impermeable press element 2.

In accordance with the present invention, blind holes and/or grooves 6 may have a width lateral to web travel direction A of, e.g., approximately 0.1 to 0.3 mm, and a depth of, e.g., approximately 2 to 5 mm.

A plurality of rows formed in impermeable press element 2 includes blind holes and/or grooves 6 that may be arranged next to one another and may be evenly spaced apart lateral to web travel direction A. Blind holes and/or hooves 6 may extend in a suitable manner substantially across an entire width of material web 1. Further, blind holes and/or grooves 6 may be offset lateral to web travel direction A from rows that may be adjacent to one another in web travel direction A.

Figure 5:
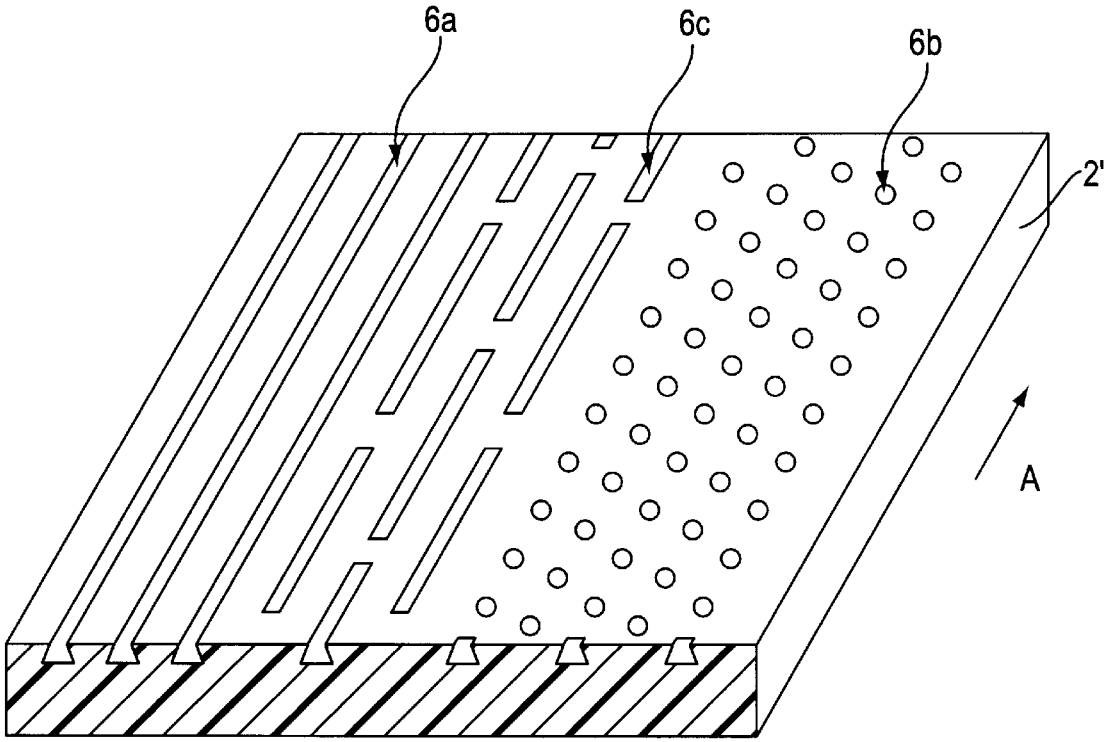
FIG. 5 illustrates a peripheral section of a press element which is flattened to more clearly illustrate grooves and blind holes.

FIG. 5 illustrates a peripheral section of a press element 2' which is flattened to more clearly illustrate a plurality of rows of blind holes or grooves 6*a* in the press face and arranged next to one another and evenly spaced lateral to a web travel direction A. FIG. 5 also shows blind holes or grooves 6*b*, 6*c* in which neighboring rows are offset relative to one another lateral to the web travel direction A. Further, FIG. 5 shows blind holes or grooves 6*a*, 6*b*, and 6*c* being located substantially over an entire width of the press element 2'.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A press device for treating a material web comprising:

an impermeable press element having a press face;

an opposing element;

a nip formed between the impermeable press element and the opposing element;

a felt belt that guides the material web through the nip and that is positioned between the material web and the opposing element;

the material web contacting the impermeable press element and being separated from the impermeable press element after leaving the nip;

the impermeable press element further comprising at least one of grooves and blind holes formed in the press face that are sized to close in the nip to form a smooth surface due to pressing forces which are sufficient to form the smooth surface, and that open after leaving the nip.

2. The press device according to claim 1, the at least one of grooves and blind holes comprising at least one groove extending in a web travel direction for a predetermined distance, wherein, when passing through the nip, the at least one groove presses air within the at least one groove out in a direction substantially counter to the web travel direction, and wherein, when leaving the nip, the at least one groove receives air into the at least one groove.

3. The press device according to claim 1, further comprising:

a plurality of rows, comprising the at least one of blind holes and grooves, in the press face and arranged next to one another and evenly spaced lateral to a web travel direction.

4. The press device according to claim 3, the at least one of blind holes and grooves of neighboring rows are offset relative to one another lateral to the web travel direction.

5. The press device according to claim 1, the at least one of blind holes and grooves being located substantially over an entire width of the press element.

6. The press device according to claim 1, the at least one of blind holes and grooves comprising at least one groove having a width of between approximately 0.1 mm and 0.3 mm and a depth of between approximately 2 mm and 5 mm.

7. The press device according to claim 1, the impermeable press element being formed as a roll having an outer surface in which the at least one of blind holes and grooves are formed.

8. The press device according to claim 7, the press jacket comprising polyurethane.

9. The press device according to claim 7, the roll comprising a deflection adjustment roll having a rotating press jacket.

10. The press device according to claim 1, the material web comprising a paper web.

11. The press device according to claim 1, wherein at least a portion of the at least one of grooves and blind holes formed in the press face completely closes in the nip such that opposite sides of the at least one of grooves and blind holes touch each other.

12. The press device according to claim 1, the at least one of grooves and blind holes comprising blind holes.

13. A press device for treating a material web comprising:

an impermeable press element having an outer surface including at least one of a grove and a blind hole that is sized to close under sufficient pressure;

the outer surface further including a flexible surface that biases the at least one of the groove and blind hole in a substantially open position;

an opposing roll abuttingly positioned adjacent the impermeable press element; and the opposing roll closing the at least one of the groove and blind hole to form a nip having a substantially smooth press face due to pressing forces which are sufficient to form the substantially smooth press face, the substantially smooth press face contacting the material web.

14. The press device according to claim 13, wherein the opposing roll forces air out of the at least one of the groove and blind hole in the nip.

15. The press device according to claim 13, wherein the opposing roll traps air within the at least one of the groove and blind hole in the nip.

16. The press device according to claim 14, the at least one of the groove and blind hole comprising at least one of grooves and blind holes arranged over a width of the outer surface for receiving the material web.

17. The press device according to claim 16, the at least one of grooves and blind holes being evenly spaced over the width of the outer surface.

18. The press device according to claim 16, the at least one of grooves and blind holes being arranged in adjacent rows spaced over the width of the outer surface.

19. The press device according to claim 18, the adjacent rows being offset over the width of the outer surface.

20. The press device according to claim 13, the outer surface comprising polyurethane.

21. The press device according to claim 13, the at least one of the groove and blind hole having a depth of between approximately 2 mm and 5 mm.

22. The press device according to claim 13, the at least one of the groove and blind hole having a width of between approximately 0.1 mm and 0.3 mm.

23. The press device according to claim 13, the impermeable press element comprising a press roll and the outer surface comprising a roll jacket; and at least one of the groove and blind hole comprising a plurality of grooves having a length formed in a substantially circumferential direction of the roll jacket.

24. The press device according to claim 13, wherein at least a portion of the at least one of the groove and blind hole formed in the press face completely closes in the nip such that opposite sides of the at least one of the groove and blind hole touch each other.

25. The press device according to claim 13, the at least one of the groove and blind hole comprising at least one blind hole.

26. A method for separating a material web from an impermeable press element in a press device after the material web has been treated by a nip formed between the impermeable press element and an opposing element, the impermeable press element including at least one of grooves and blind holes and the material web guided through the nip by a felt belt, the method comprising:

closing the at least one of grooves and blind holes adjacent the material web as the material web contacts the impermeable element and enters the nip to form a substantially smooth press face by using pressing forces which are sufficient to form the substantially smooth press face; and opening the at least one of grooves and blind holes adjacent the material web as the material web exits the nip, wherein the opening of the at least one of grooves and blind holes facilitates the separation of the web material from the impermeable press element.

27. The method according to claim 26, the closing of the at least one of grooves and blind holes comprising forcing air out of the at least one of grooves and blind holes in a direction opposite a material web transport direction.

28. The method according to claim 27, the opening of the at least one of grooves and blind holes comprising drawing air into the at least one of grooves and blind holes.

29. The method according to claim 28, the closing of the at least one of grooves and blind holes comprising trapping air within the at least one of grooves and blind holes.

30. The method according to claim 29, the opening of the at least one of grooves and blind holes comprising releasing the trapped air from within the at least one of grooves and blind holes.

31. The method according to claim 26, wherein at least a portion of the at least one of grooves and blind holes formed in the press face completely closes in the nip such that opposite sides of the at least one of grooves and blind holes touch each other.

32. The method according to claim 26, the at least one of grooves and blind holes comprising blind holes.

* * * * *